United States Patent [19]

Fuchs, Jr.

[11] 4,068,512

[45] Jan. 17, 1978

[54] APPARATUS AND METHODS FOR FORMING MULTIPLE ELONGATED PRODUCTS

[75] Inventor: Francis Joseph Fuchs, Jr., Princeton Junction, N.J.

[73] Assignee: Western Electric Company, Inc., New York, N.Y.

[21] Appl. No.: 638,493

[22] Filed: Dec. 8, 1975

[51] Int. Cl.[2] ..... B21C 23/01; B21C 23/08; B21C 23/32

[52] U.S. Cl. ..... 72/41; 72/253 R; 72/261; 72/468

[58] Field of Search ..... 72/41, 43, 44, 45, 253, 72/261, 468, 259, 271, 272

[56] References Cited

U.S. PATENT DOCUMENTS

| | | | |
|---|---|---|---|
| 2,581,614 | 1/1952 | Veit | 72/261 |
| 2,960,221 | 11/1960 | Albers | 72/253 |
| 2,973,092 | 2/1961 | Graham | 72/468 |
| 3,063,560 | 11/1962 | Edgecombe | 72/468 |
| 3,901,065 | 8/1975 | Schmehl | 72/261 |
| 3,934,446 | 1/1976 | Avitzur | 72/262 |

FOREIGN PATENT DOCUMENTS

| | | | |
|---|---|---|---|
| 937,383 | 3/1948 | France | 72/468 |
| 7,419 of | 1901 | United Kingdom | 72/261 |

*Primary Examiner*—C.W. Lanham
*Assistant Examiner*—D. M. Gurley
*Attorney, Agent, or Firm*—A. S. Rosen

[57] ABSTRACT

Multiple elongated products are formed simultaneously from a single workpiece, coated with a lubricant or other fluent material, by forcing the workpiece against and through a die having multiple apertures. The apertures are so arrayed as to permit a relatively free flow of the coating material to each of the die apertures, including one or more generally central apertures. Preferred aperture configurations include straight line arrays and shallow curves, such as shallow "S"-shaped curves. The workpiece may advantageously correspond in general shape to that of the configuration of apertures in the die through which it is to be forced.

10 Claims, 4 Drawing Figures

FIG. 1
— PRIOR ART —
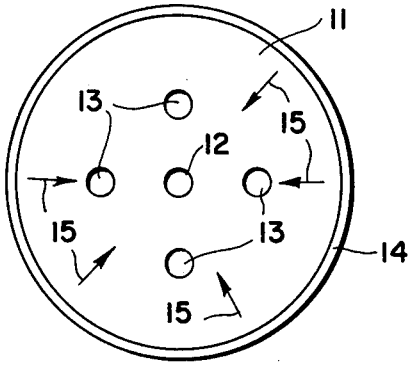
FIG. 2
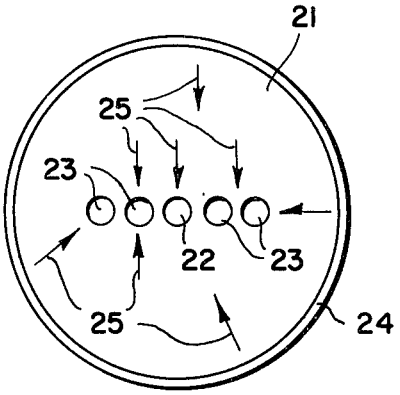
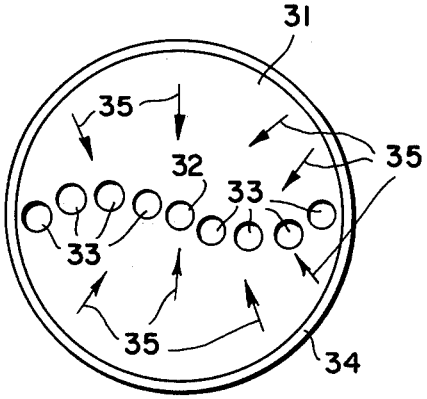
FIG. 3
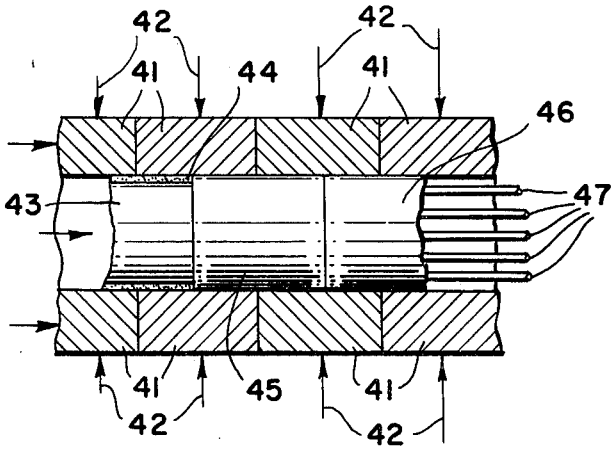
FIG. 4

APPARATUS AND METHODS FOR FORMING MULTIPLE ELONGATED PRODUCTS

BACKGROUND OF THE INVENTION

1. Field of the Invention

This invention relates to apparatus and methods for deforming a workpiece so as to produce multiple elongated products simultaneously and, more particularly, to apparatus and methods for forming multiple products simultaneously from a single workpiece on an outer surface of which a lubricant or other fluent coating material is carried.

2. Description of the Prior Art

In the art of forming elongated products, it is known to utilize hydrostatic extrusion techniques, wherein hydrostatic pressure is applied to a billet within a chamber such that the material of the billet is rendered more ductile as the billet is forced through an aperture in a die located at one end of the chamber. Some examples of such techniques may be found in my U.S. Pat. No. 3,740,985, an application for the reissue of which has been filed on Jan. 4, 1974 under Ser. No. 430,984, and has issued as U.S. Pat. RE No. 28,795 on May 4, 1976, and in my copending application, Ser. No. 612,875, filed Sept. 12, 1975, which has issued as U.S. Pat. No. 3,985,011 on Oct. 12, 1976.

It is also known in such art to provide apparatus which includes a die having a plurality of apertures extending therethrough, and to force a workpiece through such die, e.g., by the hydrostatic extrusion techniques disclosed in my patent and my applications mentioned above, so as to produce simultaneously a plurality of elongated products. For example, one such die is disclosed in U.S. Pat. No. 3,901,065 to G. L. Schmehl.

In each of the previously discussed patents and applications, it is taught that a shear transmitting fluid for advancing the billet toward and against the die may advantageously be utilized also as a lubricating material for facilitating the passage of the billet material through the die aperture or apertures. U.S. Pat. No. 3,901,065, in particular, discloses the importance of assuring an even distribution of lubricant among two or more die apertures such that each will be well lubricated, and will produce extruded product at a like rate with the other die apertures. Such patent teaches achieving this desirable result by arraying a relatively small number of die apertures radially equispaced around a circle within a conical mouth of a die at equal distances from an entrance end of the die.

In my copending application, Ser. No. 619,130, filed Oct. 2, 1975, and entitled, "Multiple Aperture Die," which is a continuation of my earlier application of like title, Ser. No. 523,404, filed Nov. 13, 1974, and which has issued as U.S. Pat. No. 3,948,079 on Apr. 6, 1976. I disclose die aperture arrays involving one or more groups of apertures, in each of which groups several apertures, located within a flared mouth area, form a circle surrounding a central aperture at the apex of the flared mouth area. This was considered initially to constitute an arrangement for providing an even distribution of both workpiece material and lubricant to each die aperture. However, it has since been found that, while the workpiece material is in fact apportioned substantially equally among all of the die apertures, the flow of lubricant to each central aperture may be interrupted materially, if more than about three die apertures are present, due to the presence of the surrounding die apertures.

The extrusion of relatively soft and plastic materials through multiholed dies is also known. Such techniques may utilize a number of various die aperture configurations, including linear configurations, as shown in U.S. Pat. No. 2,533,796 to H. Harris and L. M. Ware and, U.S. Pat. No. 3,372,432 to W. R. Howard, and in U.S. Pat. No. 3,564,088 to R. Woodell. Extrusion in accordance with these techniques does not, however, require that a coating of lubricant be employed to facilitate the passage of the billet material through the die apertures. The configurations of apertures in dies for extruding such relatively soft and plastic materials are selected purely for convenience in extruding desired product shapes.

Clearly, it would be desirable to have available alternative arrangements, providing a relatively large number of die apertures useful in producing multiple elongated products simultaneously from a single billet of other than a relatively soft and plastic material, wherein a quantity of lubricating material will be distributed to each of the die apertures, preferably in substantially equal quantities to all of the apertures, such that the operating pressures required in forming the elongated products may be reduced materially.

SUMMARY OF THE INVENTION

The invention contemplates the provision and utilization of apparatus and methods for deforming a workpiece, wherein improved die structures provide multiple apertures for forming multiple elongated products upon the forcing of the workpiece therethrough, and wherein the arrangement of the multiple apertures of the improved die structures is so selected as to promote a free flow of a lubricant or other fluent coating on the outer periphery of the workpiece to all of the die apertures, including one or more generally central apertures, as the workpiece is forced through the die apertures. Various configurations may be so selected. For example, the apertures may be arrayed along a straight line or along relatively shallow curves, such as a shallow "S"-shaped curve. In addition, the workpiece may advantageously have a shape corresponding generally to the configuration of apertures in the die used for deforming the workpiece.

Through the use of these multiple aperture dies and techniques a relatively free flow pattern for lubricant, from the workpiece surface to all of a relatively large number of die apertures, may be established, assuring a relatively low pressure, relatively trouble-free deformation process. Such process may be performed by forcing the workpiece against a die with sufficient pressure to cause various coated portions of the workpiece to pass simultaneously through all of the multiple apertures in the die.

BRIEF DESCRIPTION OF THE DRAWING

FIG. 1 of the drawing is a schematic illustration of an earlier version of a multiple aperture die for use in forming multiple elongated products simultaneously from a single coated workpiece, this figure also demonstrating the initial relationship and probable flow patterns, with respect to the die, of the workpiece coating material during the employment of the die in so forming multiple elongated products;

FIGS. 2 and 3 are schematic illustrations, similar to that of FIG. 1, depicting alternative embodiments of improved multiple aperture die structures, which may be employed in accordance with the invention in forming multiple elongated products simultaneously from a single coated workpiece, in order that the workpiece coating material, which may be a lubricant, may flow more freely and be distributed more evenly to all of the multiple apertures in each die structure during the forming of the multiple elongated products; and FIG. 4 is a longitudinal view, partly in section, of portions of apparatus which may be utilized in accordance with the principles of the invention to force a coated workpiece against and through a multiple aperture die, such as either of the dies shown in FIGS. 2 and 3, in order to form multiple elongated products simultaneously.

DETAILED DESCRIPTION

Referring initially to FIG. 1 of the drawing, a multiple aperture die 11 is shown schematically. Die 11 includes a central aperture 12 and a number of additional or outer apertures 13. The outer apertures 13 are spaced about a circle, at equal distances from the central aperture 12. Such a die is designed for use in forming multiple elongated products simultaneously from a single workpiece, for example, by hydrostatic extrusion techniques, as taught in my copending application, Ser. No. 619,130, filed Oct. 2, 1975, and entitled, "Multiple Aperture Die," which is a continuation of my earlier application of like title, Ser. No. 523,404, filed Nov. 13, 1974, and which has issued as U.S. Pat. No. 3,948,079 on Apr. 6, 1976.

It was initially believed that a lubricative coating on the outer surface of the workpiece was distributed evenly among all of the apertures of a die of this type, such that all elements of the workpiece being forced through the apertures were equally well lubricated. It has since been discovered that, where more than about three apertures are present in the die, all of the outer apertures 13 are indeed well lubricated during extrusion, but the central aperture 12 is relatively poorly, or not at all, lubricated. It is now believed that the relative lack of lubrication of the central aperture 12 results from the fact that the outer apertures 13 substantially surround the central aperture and interfere with a material portion of the flow of lubricant to the central aperture during extrusion. This effect is illustrated schematically in FIG. 1 of the drawing, wherein the outer annulus 14 represents the lubricative coating on the outer periphery of the workpiece as the workpiece is advanced into the die, and the arrows 15 represent the flow of lubricant as the various elements of the workpiece are formed through the multiple apertures 12 and 13 of the die. Clearly, the larger the number of outer apertures 13 utilized, the greater the interference with the flow of lubricant to the central aperture 12.

Turning next to FIG. 2 of the drawing, an improved arrangement of multiple die apertures is shown. A die 21 includes a number of apertures arrayed in a straight line, for example, a diametral line, there being at least one generally central aperture 22 and a plurality of additional apertures 23 extending in parallel through the body of the die. The various apertures 22 and 23 may be spaced relatively close to one another in order that a relatively large number of elongated products may be produced simultaneously using die 21.

As is illustrated schematically in FIG. 2, wherein outer annulus 24 and arrows 25 correspond to the respective outer annulus 14 and arrows 15 of FIG. 1, a relatively free flow of lubricant to all of the apertures, including the at least one generally central aperture 22, will be provided by the linear arrangement of the apertures. Interference, by virtue of one aperture blocking the path of lubricant flow from the outer periphery of the workpiece to another aperture, will be minimal, and will be restricted substantially to the two regions located radially outwardly from the outermost apertures along the line of apertures. As a result, a substantially even distribution of lubricant to all of the apertures 22 and 23 may be expected.

The aperture arrangement of FIG. 2 is considered quite useful in forming multiple elongated products simultaneously with good lubrication to all of the die apertures. For some purposes, however, it is possible that the number of die apertures which may be accommodated along a straight line may be considered insufficient. Under such circumstances, alternative arrangements of apertures may be utilized in accordance with the principles of the invention to provide relatively free lubricant flow patterns during extrusion. Such alternative arrangements may involve configurations in which the die apertures are arrayed along relatively shallow curves, such as the configuration shown in FIG. 3 of the drawing.

A die 31, depicted in FIG. 3, includes a number of apertures arrayed along a shallow "S"-shaped curve, there being at least one generally central aperture 32 and a plurality of additional apertures 33 extending in parallel through the body of the die. The various apertures 32 and 33 may be spaced relatively closely to one another in order that a relatively large number of elongated products may be produced simultaneously using die 31. Clearly, the number of apertures which may be accommodated along the curved line in die 31 is greater than that which may be present in the straight line arrangement of die 21.

As is illustrated schematically in FIG. 3, wherein outer annulus 34 and arrows 35 correspond to the respective outer annuli 14 and 24 and the respective arrows 15 and 25 of FIGS. 1 and 2, a relatively free flow of lubricant to all of the apertures, including the at least one generally central aperture 32, will be provided by the shallow curve arrangement of the apertures. Interference, by virtue of one aperture blocking the path of lubricant flow from the outer periphery of the workpiece to another aperture, is once again minimal. As a result, a substantially even distribution of lubricant to all of the apertures 32 and 33 may be anticipated.

Referring now to FIG. 4 of the drawing, pertinent portions of a preferred apparatus for utilizing multiple aperture dies, such as the dies of FIGS. 2 and 3, are depicted. This apparatus is more fully described in my copending application, Ser. No. 612,875, filed Sept. 12, 1975. The apparatus includes a number of gripping element sectors 41 which are advanced from left to right as illustrated in FIG. 4. As the sectors 41 advance toward the right, they are subjected to a continually increasing compressive pressure, as indicated by arrows 42 which increase in size from left to right.

A workpiece 43, for example, a copper or aluminum rod of indefinite length, may have a round outer periphery which is coated with a fluent material 44, corresponding to the respective outer annuli 14, 24 and 34 of FIGS. 1, 2 and 3. Shear stresses transmitted through the material 44, which may be beeswax or polyethylene wax, serve to advance the workpiece 43 from left to right in FIG. 4 with the advancing sectors 41. At the same time, compressive stresses of continually increasing magnitude are also imposed upon the advancing workpiece, thereby rendering the workpiece considerably more ductile and more suited to extrusion. The material 44, in addition to its ability to act as a shear transmitting medium, has lubricative properties, and serves to lubricate the apertures in a die 45 through which the workpiece 43 is extruded, thereby reducing the axial forces required for extrusion. Such extrusion takes place, with the workpiece rendered suitably ductile by the compressive pressures exerted upon it, as the workpiece is forced against die 45 and through its apertures by shear forces in the material 44.

Also shown in FIG. 4 are a die stem 46 associated with the die 45, and a number of elongated products 47, for example, wires of indefinite length, which are produced simultaneously by extrusion of the workpiece 43 through the die 45. The die 45 may, of course, be either of the dies 21 and 31, or any other suitable multiple aperture die constructed in accordance with the principles of the invention, the pattern of the elongated products 47 corresponding to the configuration of apertures of the particular die utilized. By employing such dies in the apparatus of FIG. 4, all elements of the workpiece 43 extruded through the die apertures will be amply coated with the lubricative material 44 as they undergo extrusion.

As illustrated in FIGS. 1–3 by virtue of the shape of the respective outer annuli 14, 24 and 34, a workpiece 43 (FIG. 4) of circular cross-section may be utilized. Workpieces 43 of various other shapes may also be deformed using dies of the types shown in FIGS. 2 and 3. In particular, it may be considered desirable to have the workpieces 43 and the die aperture arrangements correspond in shape to as great and extent as possible. For example, relatively flat, relatively wide workpiece 43, substantially matching the linear configuration of the apertures 22 and 23, might advantageously be utilized in practicing the invention with die 21 of FIG. 2. Clearly, the pattern of flow of lubricant, from the surface of such a workpiece 43 into the apertures 22 and 23 during extrusion, would be largely uniform to all of such apertures.

It is to be understood that the described apparatus and methods are simply illustrative of certain embodiments of the invention. It should be clear that various patterns of apertures other than those depicted in FIGS. 2 and 3 of the drawing, may be selected to afford the desired relatively free flow of a fluent coating material, whether it be a lubricant or otherwise, to multiple apertures in a die through which a workpiece is forced. Any suitable workpiece deforming mechanism which incorporates a die, and not merely the hydrostatic extrusion apparatus discussed with reference to FIG. 4, may, of course, be used as the apparatus of this invention, and with which the method of the invention is practiced. Similarly, many other modifications within the scope of the invention will also be apparent to a person with ordinary skill in the art.

What is claimed is:

1. Apparatus for deforming a lubricant-coated, metallic workpiece to produce simultaneously a plurality of elongated, metallic products, said apparatus comprising:

a die having a plurality of discrete apertures extending in parallel therethrough, including at least one generally central aperture and a plurality of additional apertures, said at least one generally central aperture being located closer to a center of the die than is each of said additional apertures, said plurality of discrete apertures being arrayed along an open-ended curve selected to promote a free flow of the lubricant coating on the metallic workpiece both to said at least one generally central aperture and to said additional apertures upon a forcing of said metallic workpiece against and through the die, while simultaneously permitting numerous apertures to be included in the array of apertures so as to reduce the pressure required for said forcing; and means for forcing the lubricant-coated, metallic workpiece against said die with sufficient pressure to cause different lubricant-coated portions of the metallic workpiece to pass simultaneously through said at least one generally central aperture and said additional apertures while applying the lubricant coating to each of said generally central and additional apertures, such that a plurality of elongated, metallic products is produced.

2. Apparatus as set forth in claim 1, wherein said at least one generally central aperture and said plurality of additional apertures are arrayed in a generally "S"-shaped configuration.

3. Apparatus as set forth in claim 1 for use in deforming a non-circular, lubricant-coated, metallic workpiece, wherein said at least one generally central aperture and said array of additional apertures together form a configuration corresponding substantially to the shape of the lubricant-coated, metallic workpiece.

4. Apparatus as set forth in claim 1, wherein said forcing means comprises:

means for applying shear stresses through the lubricant coating and to the metallic workpiece, said shear stresses being directed toward the die and having a magnitude sufficient to advance the metallic workpiece toward and through the die.

5. A method of deforming a lubricant-coated, metallic workpiece to produce simultaneously a plurality of elongated, metallic products, said method comprising:

a. aligning the lubricant-coated, metallic workpiece with a die having a die body which includes a plurality of discrete apertures extending therethrough, said discrete apertures being arrayed along an open-ended curve selected to promote a free flow of the lubricant coating on the metallic workpiece to all of said discrete apertures upon a forcing of said metallic workpiece against and through the die, while simultaneously permitting numerous apertures to be included in the array of apertures so as to reduce the pressure required for said forcing; and b. forcing the lubricant-coated, metallic workpiece against, and through the plurality of apertures of, said die.

6. A method as set forth in claim 5, further comprising an initial step of:

c. shaping the metallic workpiece in substantial conformity with the configuration of the apertures in the die.

7. A method as set forth in claim 5, wherein step (b) comprises:

c. applying shear stresses through the lubricant coating and to the metallic workpiece, said shear stresses being directed toward the die and having a magnitude sufficient to advance the metallic workpiece toward and through the die.

8. A method of deforming a lubricant-coated, metallic workpiece to produce simultaneously a plurality of elongated, metallic products, said method comprising:

a. aligning the lubricant-coated, metallic workpiece with a die having a die body which includes a plurality of discrete apertures extending therethrough, said discrete apertures being arrayed in a general "S"-shaped configuration selected to promote a free flow of the lubricant coating on the metallic workpiece to all of said discrete apertures upon a forcing of said metallic workpiece against and through the die, while simultaneously permitting numerous apertures to be included in the array of apertures so as to reduce the pressure required for said forcing; and b. forcing the lubricant-coated, metallic workpiece against, and through the apertures of, said die.

9. A method as set forth in claim 8, further comprising an initial step of:

c. shaping the metallic workpiece in substantial conformity with the configuration of the plurality of apertures in the die.

10. A method as set forth in claim 8, wherein step (b) comprises:

c. applying shear stresses through the lubricant coating to the metallic workpiece, said shear stresses being directed toward the die and having a magnitude sufficient to advance the metallic workpiece toward and through the die.

* * * * *